United States Patent [19]

O'Malley

[11] Patent Number: 4,989,326

[45] Date of Patent: Feb. 5, 1991

[54] QUILTING TOOL FOR MAKING THE LOCATION OF STITCHES ALONG A SEAM

[76] Inventor: Lorraine J. O'Malley, 25338 W. Lake Shore Dr., Barrington, Ill. 60010

[21] Appl. No.: 41,857

[22] Filed: Apr. 22, 1987

[51] Int. Cl.[5] ..... B41K 1/22; B41G 3/00

[52] U.S. Cl. ..... 33/36; 33/37

[58] Field of Search ..... 101/35, 36, 37, 368, 101/375, 212, 24, 30, 26, 328; 33/34, 36, 37, 19.1, 19.2, 19.3; 401/138, 193, 208, 219

[56] References Cited

U.S. PATENT DOCUMENTS

| | | | |
|---|---|---|---|
| 846,919 | 3/1907 | Herman | 33/36 X |
| 874,588 | 12/1907 | Hays | 33/36 |
| 1,117,475 | 11/1914 | Berggren | 401/208 |
| 1,225,067 | 5/1917 | Simpson | 33/34 |
| 1,751,001 | 3/1930 | Guth | 33/10 |
| 2,974,583 | 3/1961 | Friedman | 101/328 |
| 3,184,771 | 5/1965 | Bowman | 12/142 R |
| 3,487,777 | 1/1970 | Friedman | 101/375 |
| 3,546,779 | 12/1970 | Klein | 33/36 |
| 4,372,049 | 2/1983 | Hogue | 33/36 |

*Primary Examiner*—Clifford D. Crowder
*Attorney, Agent, or Firm*—Stephen A. Litchfield

[57] ABSTRACT

An apparatus for marking a cloth or other material for the precise placement of stitches in a quilt. The apparatus includes a handle portion having extended therefrom a stem or elongated bar which includes a means for containing a marking medium such as ink or chalk and a wheel rotatably connected to the end of the stem, the wheel having a series of spaced points thereon, the points communicating with the marking medium such that as the wheel is rolled across the cloth the spaced pointed portions of the wheel mark the cloth in a manner that shows the placement of stitches thereon. A spacer bar is provided adjacent the wheel for spacing the wheel a precise distance from the edge of the material. The marking means includes a well and, in an alternative embodiment, may include ink or chalk cartridges placed therein for providing the ink or chalk to the wheel. The handle is angled from the stem such that it provides an easy operation of the pointed wheel across the cloth.

17 Claims, 3 Drawing Sheets

QUILTING TOOL FOR MAKING THE LOCATION OF STITCHES ALONG A SEAM

BACKGROUND OF THE INVENTION

This invention relates in general to apparatus for sewing or quilting materials together and in particular to an apparatus for locating a seam in a material.

In the past, hobby quilters and those engaged in hand making quilts have had a difficult time placing stitches along a seam and locating the seam along the edge of a material. Often, hand stitching or quilting a seam along a material was accomplished by sight. This prior method provided opportunity for nonuniform stitches and for seams that were not straight. Also, on a piece of material that required a curved seam the hand stitcher often had trouble developing the curve of the seam by hand. The evenness of the stitches depends on the location of each stitch with respect to adjacent stitches. Accordingly, the beauty of a quilted piece can be affected by the competency, experience, and efficiency of the stitcher. If an error is made by the stitcher in judging the proper location of the start or completion of the stitch, the stitch must be removed and restarted. Also, if the stitch has been completed, the thread must be removed and entirely restarted, or the piece discarded. In either event, damage to the material may occur with the attendant possibility of marring the appearance of the cloth or piece. Further, the seam formed by the stitches must be straight. A commonly used measurement for spacing the seam from the edge of the material is one quarter of an inch. When judging the seam location by sight, the seam is often misplaced and will not be uniformly placed from the edge of the material. This also affects the overall appearance of the quilted piece. Thus, the operation of stitching can be a time consuming and frustrating matter, particularly for the beginning or inexperienced quilter.

A number of patents in the past have attempted to solve in particular applications the problems of stitch or seam location. The patent to Bowman, U.S. Pat. No. 3,184,771, shows a method and apparatus for premarking shoe vamps preparatory to hand stitching. The Bowman apparatus, while able to premark a shoe vamp, would not work in a quilting application as the Bowman apparatus is a heavy, relatively difficult to manufacture apparatus, and is intended for application to scoring shoe leather. The patent to Guth, U.S. Pat. No. 1,751,001, shows a cloth marking device for the purpose of replacing the marking chalk used by tailors in tailoring suits and clothes. The Guth device is intended to apply a line on material for the purpose of making an alteration and not for providing a means by which stitches or a seam can be accurately located and premarked on a material.

Thus, there is a need in the field for an apparatus that is hand held, economical to manufacture and able to provide a means by which individual stitches can be premarked on a quilt in an even and uniform manner, other than by sight. Further, there is a need in the field for a stitching aid which will assist the quilter in forming a straight and uniform seam along an edge.

SUMMARY OF THE INVENTION

It is therefore an object of the present invention to minimize the occurrence of human error in hand stitching of quilts. It is thus a primary object of the present invention to provide a means for premarking material preparatory for hand stitching.

It is an object of the present invention to provide an apparatus which is hand held, lightweight, economical to manufacture and able to be used by either an inexperienced or experienced stitcher for accurately premarking both seam and stitch placement on a material.

It is another object of the present invention to provide a hand held apparatus which will accurately mark the placement of stitches along a seam.

It is a further object of the present invention to provide a hand held apparatus which will accurately premark and locate the seam along the edge of a material.

Further objects and advantages of the invention will in part become apparent as the following description proceeds. The features of novelty which characterize the invention will be pointed out with particularity in the claims annexed to and forming a part of the specification.

The above and further objects are realized in accordance with the present invention by providing a hand held marking tool comprising a handle with an elongated bar or item extending therefrom, said stem having a well, or opening for containing a marking medium therein. Rotatably connected adjacent the well and communicating therewith is a pointed wheel having pointed, spaced projections mounted thereon. The pointed, projections are spaced at generally 24 points per inch when rolled along a linear surface. This provides 12 stitches per inch along a seam, which is generally desired in quilting; however, other spacings could be provided to meet other applications. The points of the pointed wheel communicate with the marking medium through a means for returning the marking medium adjacent the points such that the marking medium is deposited at the end of the points and is able to be rolled on to the cloth or material by the points. The pointed wheel is mounted between two spacer bars which are connected at an angle to the elongated bar or stem. The spacer bars are spaced at a predetermined width for allowing a hand quilter to run the spacer bar along the edge of a material thereby exactly spacing the pointed wheel a select distance from the edge of the material to form an exact and uniform seam. Further, the pointed wheel is located on the spacer bars such that the end of the bars are a select distance from the bottom-most point on the wheel and such that the end of the spacer bars will locate the end of a seam along an edge. In an alternative embodiment, the handle or shaft may house an ink cartridge which is replaceable and which supplies ink to the points of the pointed wheel. The marking medium may be of either ink or of chalk or any other acceptable material that will mark the fabric. Preferably, a water soluble ink or chalk is used so that the evidence of the marking may be removed after the stitch is formed. A removable cap covers the ink or marking medium well and may be removed to provide for replacement of the marking medium.

BRIEF DESCRIPTION OF THE DRAWINGS

The features of the present invention which are believed to be novel are set forth with particularity in the appended claims. The invention, together with further objects and advantages thereof may best be understood by reference to the following description, taken in conjunction with the accompanying drawings in the several figures of which like reference numerals identify like elements, and in which:

DETAILED DESCRIPTION

Figure 1:
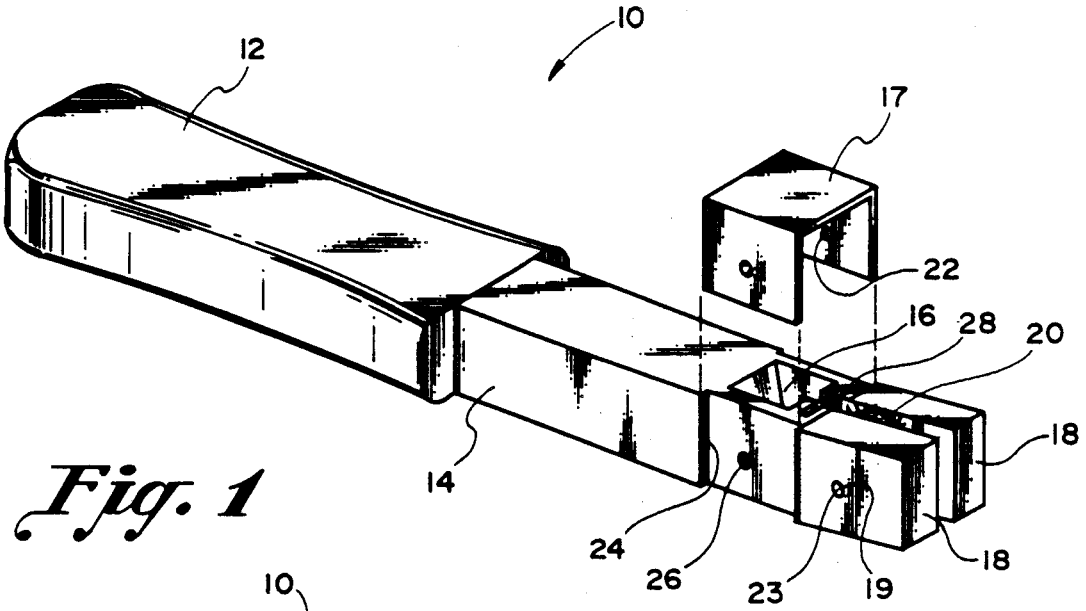
FIG. 1 illustrates a top perspective view of the quilting apparatus.

Referring now to the drawings, FIG. 1 represents quilting apparatus 10 in perspective view showing handle 12 connected to the elongated bar 14. Elongated bar 14 has connected thereto spacers 18 which have a slot therebetween and in which is mounted pointed wheel 20. Pointed wheel 20 is rotatably mounted between spacers 18 by virtue of axle 23 mounted through opening 19 in spacers 18. Marking medium Well 16 is shoWn formed in elongated bar 14 for the purpose of collecting and maintaining the marking medium therein. Cap 17 is fitted over the bar 14 over the recessed section 24 to seal the well 16. Sponge 28 receives the flow of the marking medium and holds it for the points of pointed wheel 20 as the wheel is rotated. Cap 17 is secured to elongated bar 14 by means of projection 22 formed on the inner side of both ends of cap 17 where said projections 22 mate with indentations 26 formed on both sides of the recessed section 24 of bar 14.

Figure 2:
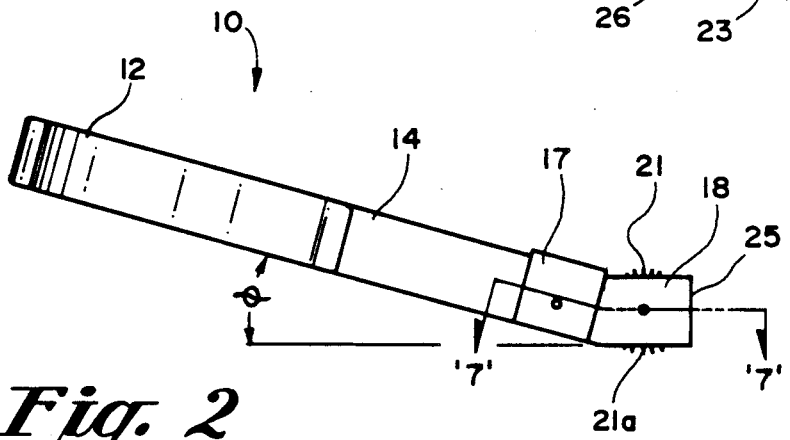
FIG. 2 is a side view of the quilting apparatus.

FIG. 2 illustrates in side view the quilting apparatus 10 and also illustrates the angle at which the spacers 18 are mounted to the elongated bar 14 such that the handle 12 of the quilting apparatus 10 is removed a select distance from the cloth or material over which the quilting apparatus 10 is moved. Angle theta illustrates the angle at which the handle is removed from the cloth material to allow the users hand to comfortably grasp the handle without obstructing the material. It is believed that this angle in one embodiment would be approximately 15 to 20 degrees from the horizontal which on a elongated bar and handle measuring five inches would remove the handle far enough from the cloth material to allow the users hand to comfortably fit around the handle without interfering with the cloth. However, variations in the angle may be used as desired so long as enough space is left between the handle and the cloth to allow the user's hand to comfortably grasp the handle 12 without interfering with the cloth. FIG. 2 also illustrates the relationship of the pointed wheel 20 with respect to the spacers 18 such that only the pointed ends 21 of the pointed wheel project past the bottom of the spacers 18. Spacers 18 are of a select width and in the preferred embodiment would be one quarter inch wide each. These spacers 18 allow the user to run the quilting tool along the edge of a material such that the outer edge of the spacer is immediately adjacent the edge of the material and thereby spaces the pointed wheel approximately one quarter inch from the edge of the material. It should also be noted as shown in FIG. 2 that the bottom most point, point 21*a*, is shown a select distance from the outer end 25 of spacer 18. This arrangement allows the spacer to serve as a means for locating the end of the seam at the end of the material. In other words, by spacing the bottom most point 21*a* approximately one quarter inch from the outermost end 25 of spacer 18. When the user reaches the end of the material, such that the outermost end 25 of spacer 18 is adjacent the material end, the bottom most point 21A of pointed wheel 20 will be a quarter inch from the end of the material. Thus, the spacer bars 18 serve to space the seam for the stitches not only along a parallel edge of material, but at the top most edge of material as the quilting apparatus 10 is run along the edge. Thus, the quilting tool will define both the location of the seam, the location of the stitches in the seam and the end of the seam.

Figure 4:
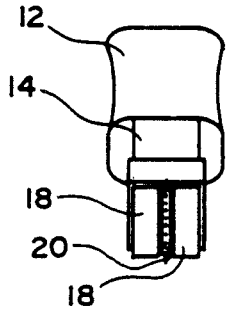
FIG. 4 is an end view of the quilting apparatus.
Figure 3:
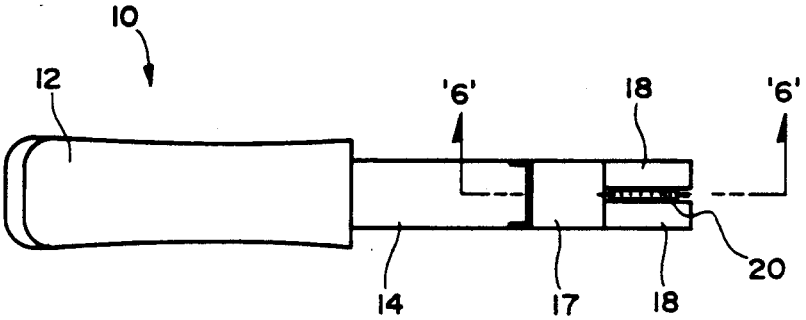
FIG. 3 is a top view of the quilting apparatus.

FIG. 3 illustrates a top view of the quilting apparatus 10 and shows the relationship of cap 17 with respect to the elongated bar 14, when installed. Also, FIG. 3 illustrates the relationship of spacers 18 with respect to the pointed wheel 20 mounted therein. FIG. 4 illustrates in end view the relationship of spacers 18 with respect to pointed wheel 20. Note again that points 21 project below the bottom of spacers 18, however, the actual wheel itself is well within the confines of spacers 18 to avoid interfering with the quilting material.

Figure 5:
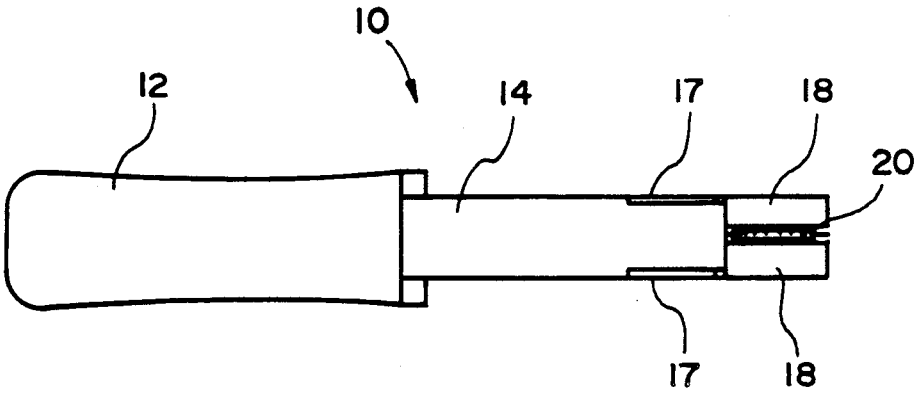
FIG. 5 is a bottom view of the quilting apparatus.

FIG. 5 illustrates the bottom view of quilting apparatus 10 illustrating again the relationship of cap 17 to recessed section 24 of the elongated bar 14. Also, it should be noted that pointed wheel 20 is mounted between both spacers 18 to allow the flexibility of using the spacers on both sides of the wheel to act as a means for measuring the location of the seam from the edge of the material.

Figure 6:
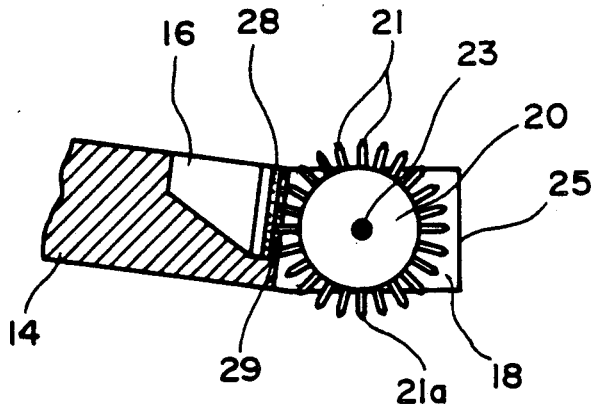
FIG. 6 is a side section view of the quilting apparatus as shown along the section lines 6—6 of FIG. 3.

FIG. 6 illustrates a cut-away view of the spacers 18 and pointed wheel 20, exposing the well 16 and, sponge 28. It should be noted that sponge 28 has groove 29 formed therein allowing points 21 of pointed wheel 20 to communicate therewith such that the points pick up the ink flowing from the well 16 into sponge 28. Sponge 28 may be removed from well 16 for cleaning or replacement as needed.

In quilting applications, it is desired generally to have 12 stitches per inch, thus, the pointed wheel 20 is dimensioned such that one revolution of wheel 20 over a linear surface will mark one inch. In order to have 12 stitches per inch, 24 points are spaced thereon such that 24 locations will be formed or marked on a linear inch when run along a material. Thus, by receiving the marking medium, usually ink, through groove 29 on sponge 28, the points 21 then deliver the marking medium to the material to locate the precise locations where the stitches should be formed along the seam. When used in combination with the spacer bars placed adjacent the outer edge of a material, the quilting tool 10 will accurately mark the locations of stitches such that 12 stitches per inch will be marked along a seam and a straight seam along an edge will be marked.

It should be noted that the pointed wheel 20 can be made to be removable from the spacer bars 18 allowing another pointed wheel to be inserted which has different point spacing. This would allow the quilting tool 10 to be used in other sewing or stitching applications where the number of stitches per inch is different from the standard 12 stitches per inch desired for quilting.

Figure 7:
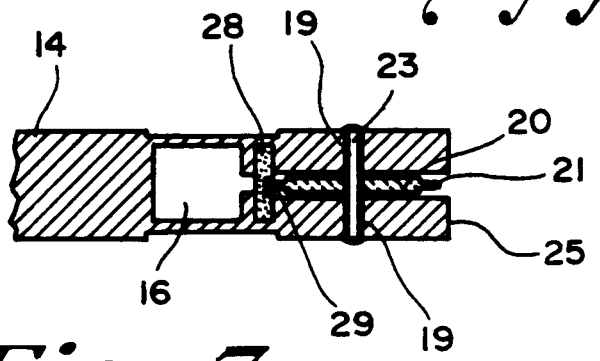
FIG. 7 is a bottom section view taking along section lines 7—7 of FIG. 2.

FIG. 7 illustrates the relationship of the well 16 with respect to the sponge 28 and groove 29. It is seen in the bottom section view of FIG. 7 that the points 21 of pointed wheel 20 project into groove 29 of sponge 28 as the wheel is rotated through the sponge 28. Axle 23 is used to mount pointed wheel 20 between spacers 18 through openings 19 in spacers 18. The relationship of the bottom most point 21A is further shown in FIG. 6 with respect to the outer most end 25 of spacer 18. Again, this serves to locate the end of the seam when the outermost end 25 of spacer 18 reaches the end of the material.

Figure 8A:
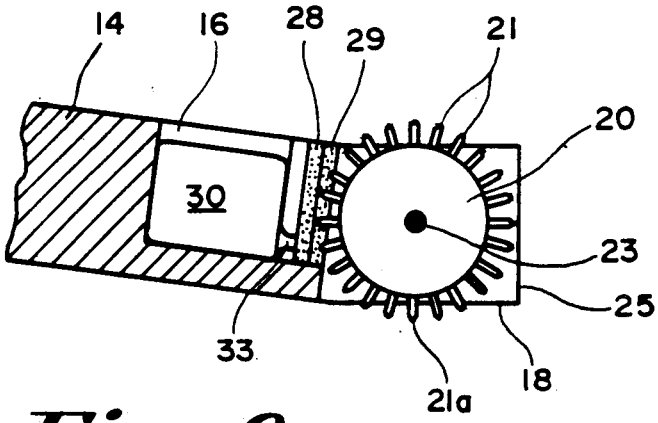
FIG. 8A is a section view of the quilting apparatus showing an alternative embodiment.

FIG. 8*a* illustrates an alternative embodiment wherein an ink cartridge is shown placed in well 16 to contain the ink used in the quilting apparatus. Opening 33 of ink cartridge 30 communicates with sponge 28 and deposits the ink onto the sponge 28. In the alternative embodiment shown in of FIG. 8*a*, the groove 29 and sponge 28 would serve as the means by which the ink is departed to the points 21 of pointed wheel 20 thereby allowing the individual points to mark the material for stitch placement.

Figure 8B:
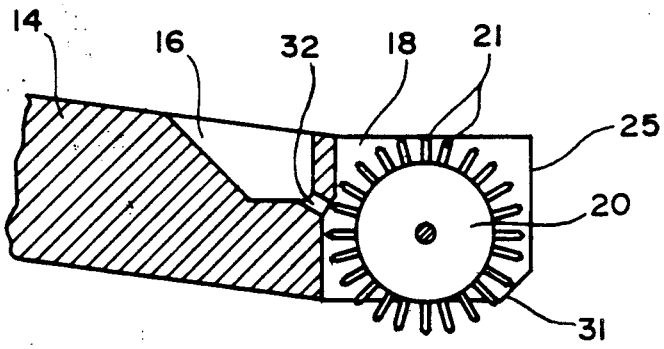
FIG. 8B is a side section view showing another alternative embodiment.

FIG. 8*b* shows a further alternative embodiment having the bottom of well 16 slanted and having opening 32 communicating with the points 21 of pointed wheel 20. The well 16 as modified in FIG. 8*b* would be compatible with a marking medium such as powdered chalk which would be deposited on the points 21 as the wheel 20 is rotated. The chalk is then used to mark the individual stitch locations. It should be noted that outer most end 25 of spacer 18 is slanted or chamfered at 31 to further provide for ease of operation along the cloth material. In further alternative embodiments, the bottom most ends at 31 of spacers 18 could be rounded if it was found that the rectangular ends shown would interfere with the particular material being used. However, it is felt that the rectangular shape of spacer 18 is an advantage in that it helps to more precisely define the location of the seam with respect to the edge of the material.

Figure 9:
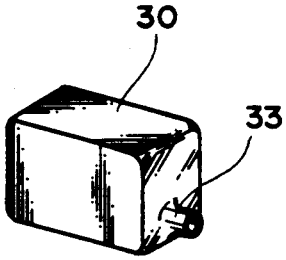
FIG. 9 is a top perspective view of the cartridge for the quilting apparatus.

FIG. 9 shows in top perspective view the ink cartridge 30 which would be placed within well 16 in FIG. 8A. Ink cartridge 30 could be commercially manufactured such that as they are depleted they would be discarded and replaced. Also, ink cartridge 30 could be manually filled as it is emptied from a common ink source. It is anticipated that a water soluble ink will be used as the marking medium, however, a water soluble chalk could also be used as shown in FIG. 8*b*. Other types of marking mediums may be acceptable preferably those that do not leave permanent marks on the material where the seam is formed. It is anticipated that the spacers 18 would be manufactured of clear plastic a quarter inch wide and approximately ⅞ of an inch long and again would be attached to both sides of pointed wheel 20. The handle could be manufactured ether of steel, rubber or plastic depending on manufacturing conditions and material availability and the elongated bar could be either steel, plastic or other material again depending on manufacturing conditions and material availability.

To use the device the quilter would insure that the well 16 is filled with the appropriate marking medium or cartridge and would then align the spacer bar 18 with the edge of the material to be sewn. The quilting tool is then run along the edge keeping the outer most end of spacer bar 18 aligned therewith. The points 21 of pointed wheel 20 will then indicate the precise stitch locations and premark the seam to the end of the material where the outer end 25 of spacers 18 will locate the end of the seam. The above disclosed device will work on straight seams and will work on material having curved seams since the spacer 18 need only be kept along the edge of the material, no matter what its shape.

It is felt that the above disclosure provides a unique and novel description of an apparatus intended to assist a quilter in forming the proper stitch location as well as proper seam location with respect to the edge of the material. The invention, however, is not limited to the particular details of construction of the device depicted, and other modifications and applications are contemplated. For example, various types of wells may be provided as well as various types of means for communicating the marking medium to the pointed wheel. Also, rather than using clear plastic as the spacer bars 18, the wheel could be mounted by means of a wire assembly having wire guides indicating the exact quarter inch location of the seam from an edge of a material. Further, one of the spacer bars 18 could be manufactured of a different width and length than the other spacer bar 18 to provide a means by which a seam could be located at a different distance than that of the first spacer bar 18. This would provide a flexibility for the tool to measure more than one seam and stitch location. Certain other changes may also be made in the above described device without departing from the true spirit and scope of the invention herein involved. It is intended therefore that the subject matter in the above depiction shall be interpreted as illustrative and not in a limiting sense.

I claim:

1. Apparatus for locating and marking a seam on a material and for locating and marking the placement of individual stitches along the seam comprising a handle having formed thereon an elongated member said member having a means for locating a seam and a means for premarking a seam on said material, said means for locating the seam comprising a spacer bar having a select width and a select length and a means for mounting the seam premarking means therein, said spacer bar formed adjacent the elongated member at an angle thereto; a means for containing a marking medium housed in said tool and a marking medium deposited therein; said means for premarking a seam comprising a wheel and an axis extending through said wheel, said wheel rotatably mounted at said axle to said spacer bar at the mounting means such that said wheel does not project below the spacer bar, said mounting means comprising an opening in the spacer bar to receive the axis, said wheel having extending therefrom and thereround a series of spaced, elongated points, said points arranged such that as the wheel is rotated with respect to the spacer bar each point individually communicates with the marking medium and the marking medium is thereby deposited on each of the points; said points projecting below the spacer bar so as to mark the material with the marking medium as the spacer bar is moved over the material, such that the spacer bar cooperates with the wheel to locate the position of a seam on the material and the wheel points individually mark the location for placement of individual stitches along the seam.

2. The apparatus of claim 1 where the means for containing the marking medium comprises a well formed in the elongated member of the tool, said well having a removable means to cover said well for filling with a marking medium and a means for maintaining the marking medium adjacent the means for premarking the seam location.

3. The apparatus of claim 2 where the means to cover said well comprises a removable cap placeable over said well and having means for securing said cap over the well.

4. The apparatus of claim 2 where the means for maintaining the marking medium adjacent the means for premarking the seam location comprises a sponge located adjacent an end of the well and adjacent the points of the wheel such that the marking medium is deposited on the points of the wheel as the points are rotated past the sponge.

5. The apparatus of claim 1 where the marking medium is water soluble ink.

6. The apparatus of claim 1 where the marking medium is chalk.

7. The apparatus of claim 1 where the means for containing a marking medium comprises a well formed in the elongated member, said well housing a cartridge having an opening therein and said cartridge containing said marking medium, such that the marking medium flows through said cartridge opening and adjacent the means for premarking the material as the tool is moved over the material.

8. A quilting tool apparatus comprising a means for locating the position of a seam on a material and a means for locating individual stitches along said seam, said stitch locating means connected adjacent the seam locating means and said seam locating means connected at an angle thereto to a means for grasping the quilting tool; and marking medium contained in a well located in said grasping means, said well communicating with the means for marking the location of individual stitches such that the marking medium is deposited on the stitch locating means for placement on the material to locate the position of the individual stitches; said means for locating the position of a seam comprising a spacer bar having a select width and a select length, such that placing an outer edge of the spacer bar adjacent an edge of the material to be quilted will position the stitch locating means at a desired location to mark the seam and the individual stitches as the tool is moved over the material; said spacer bar having an opening therein to receive the stitch locating means; said stitch locating means comprising a wheel rotatably connected to the spacer bar such that said wheel does not project below the spacer bar, said wheel having a series of pointed projections extending therefrom at select, spaced intervals there around, such that the various spaced, pointed projections extend below the spacer bar to penetrate the material to be quilted as the wheel is rotated over the material.

9. The apparatus of claim 8 where the means for grasping the quilting tool comprises an elongated handle having an elongated member projecting therefrom; said well located in the elongated member.

10. The apparatus of claim 8 where the pointed projections are spaced to provide 24 uniformly spaced marks on a material per inch as the wheel is rotated over the material.

11. The apparatus of claim 8 where the means for holding the marking medium comprises a sponge adjacent an opening in the well and adjacent the individual spaced pointed projections, said sponge having a groove therein for receiving the spaced pointed projections and for depositing the marking medium thereon as they are rotated through said groove.

12. The apparatus of claim 11 where the sponge is removable from the well for cleaning or replacement.

13. The apparatus of claim 8 where the seam locating means includes a second rectangular spacer bar formed parallel to said first spacer bar, on said elongated member, said stitch locating means mounted between said first and second spacer bar, said second spacer bar having a select width and length and an opening therein to receive the stitch locating means, said second spacer bar formed on the elongated member at the same angle thereto as the first spacer bar.

14. The apparatus of claim 8 wherein the marking medium is water soluble ink.

15. The apparatus of claim 8 wherein the marking medium is chalk.

16. The apparatus of claim 8 where the spacer bar has a select length and the wheel is mounted at a select location on the spacer bar such that when the outermost edge of the spacer bar reaches the edge of the material to be quilted the end of the seam is located.

17. The apparatus of claim 8 wherein the stitch locating means is removable from the spacer bar for cleaning or for replacement with a stitch locating means which will locate stitches along a seam at intervals varying from those of the first spacer wheel.

* * * * *